United States Patent [19]

Senor

[11] Patent Number: 4,932,888

[45] Date of Patent: Jun. 12, 1990

[54] MULTI-ROW BOX CONNECTOR

[75] Inventor: Ronald E. Senor, North Attleboro, Mass.

[73] Assignee: Augat Inc., Mansfield, Mass.

[21] Appl. No.: 367,950

[22] Filed: Jun. 16, 1989

[51] Int. Cl.[5] ..... H01R 13/648

[52] U.S. Cl. ..... 439/108; 439/607

[58] Field of Search ..... 439/65, 79, 83, 92, 439/95, 108, 607, 609, 876

[56] References Cited

U.S. PATENT DOCUMENTS

| | | | |
|---|---|---|---|
| 3,671,917 | 6/1972 | Ammon et al. | 339/17 L |
| 4,184,735 | 1/1980 | Ammon et al. | 339/217 L |
| 4,226,496 | 10/1980 | Langham | 339/176 MP |
| 4,392,705 | 7/1983 | Andrews, Jr. et al. | 339/75 MP |
| 4,500,149 | 2/1985 | Mackay | 339/17 C |
| 4,655,518 | 4/1987 | Johnson et al. | 339/17 LC |
| 4,659,155 | 4/1987 | Walkup et al. | 439/108 |
| 4,734,042 | 3/1988 | Martens et al. | 439/62 |
| 4,806,110 | 2/1989 | Lindeman | 439/108 |

*Primary Examiner*—Eugene F. Desmond

*Attorney, Agent, or Firm*—Weingarten, Schurgin, Gagnebin & Hayes

[57] ABSTRACT

A multi-row box connector having continuous ground planes formed as part of the connector housing for electrically interconnecting printed circuit boards. The multi-row box connector includes first and second insulative housing members each having thin metallic films deposited on the internal and external sidewalls thereof, respectively, to form the continuous ground planes. The thin metallic films may be deposited on respective housing members by sputtering. The ground planes provide early ground mate as well as EMF shielding and minimization of cross talk between the signal elements of the box connector.

9 Claims, 4 Drawing Sheets

MULTI-ROW BOX CONNECTOR

FIELD OF THE INVENTION

The present invention is directed to electrical connectors, and more particularly to a multi-row box connector having ground planes formed as part of the connector housing.

BACKGROUND OF THE INVENTION

Multi-row box connectors may be utilized to electrically interconnect printed circuit boards. Typically such box connectors include two connector housing members which are mated together to form the box connector. One housing member is configured for surface mounting to a first printed circuit board while the other housing member may be configured for either surface mounting or edge mounting to a second printed circuit board.

The box connector is configured to include the conductive elements which provide electrical interconnection between the first and second printed circuit boards. Generally this entails a complex housing structure and intricate contact configurations which increases the cost and time involved in fabrication and assemblage. Moreover, with the increasing circuit density of present day printed circuit boards, it is generally advantageous to minimize the overall size of the box connector while increasing the signal element density thereof.

SUMMARY OF THE INVENTION

The present invention is directed to a multi-row box connector having a simplified configuration which minimizes the overall size of the box connector and provides the capability for readily increasing the signal element density thereof depending upon the particular application. The multi-row box connector comprises a two-piece insulative housing which includes grounding elements of simplified configuration which may be readily integrated into the respective housing members.

The housing members are formed to have continuous ground planes by depositing thin metallic films on the internal and external insulative sidewalls thereof, respectively. Deposition may be accomplished by sputtering the thin metallic film directly on the respective sidewalls. During mating of the housing members to form the box connector, engagement occurs between the respective ground planes to provide early ground mating. The ground planes also provide EMF shield for and minimize cross talk between the signal contact elements of the box connector. The ground planes also provide controlled impedance, inductance and capacitance for the box connector.

The first housing member of the box connector is configured to receive ground pin modules which engage the internal ground planes thereof and the ground elements of the first printed circuit board to provide electrical interconnection therebetween. The second housing member is configured to receive grounding bars which engage the external grounding planes thereof and the ground elements of the second printed circuit board to provide electrical interconnection therebetween.

BRIEF DESCRIPTION OF THE DRAWINGS

A more complete understanding of the present invention and the attendant advantages and features thereof will be more readily understood by reference to the following detailed description when considered in conjunction with the accompanying drawings wherein.

DETAILED DESCRIPTION OF PREFERRED EMBODIMENTS

Figure 1:
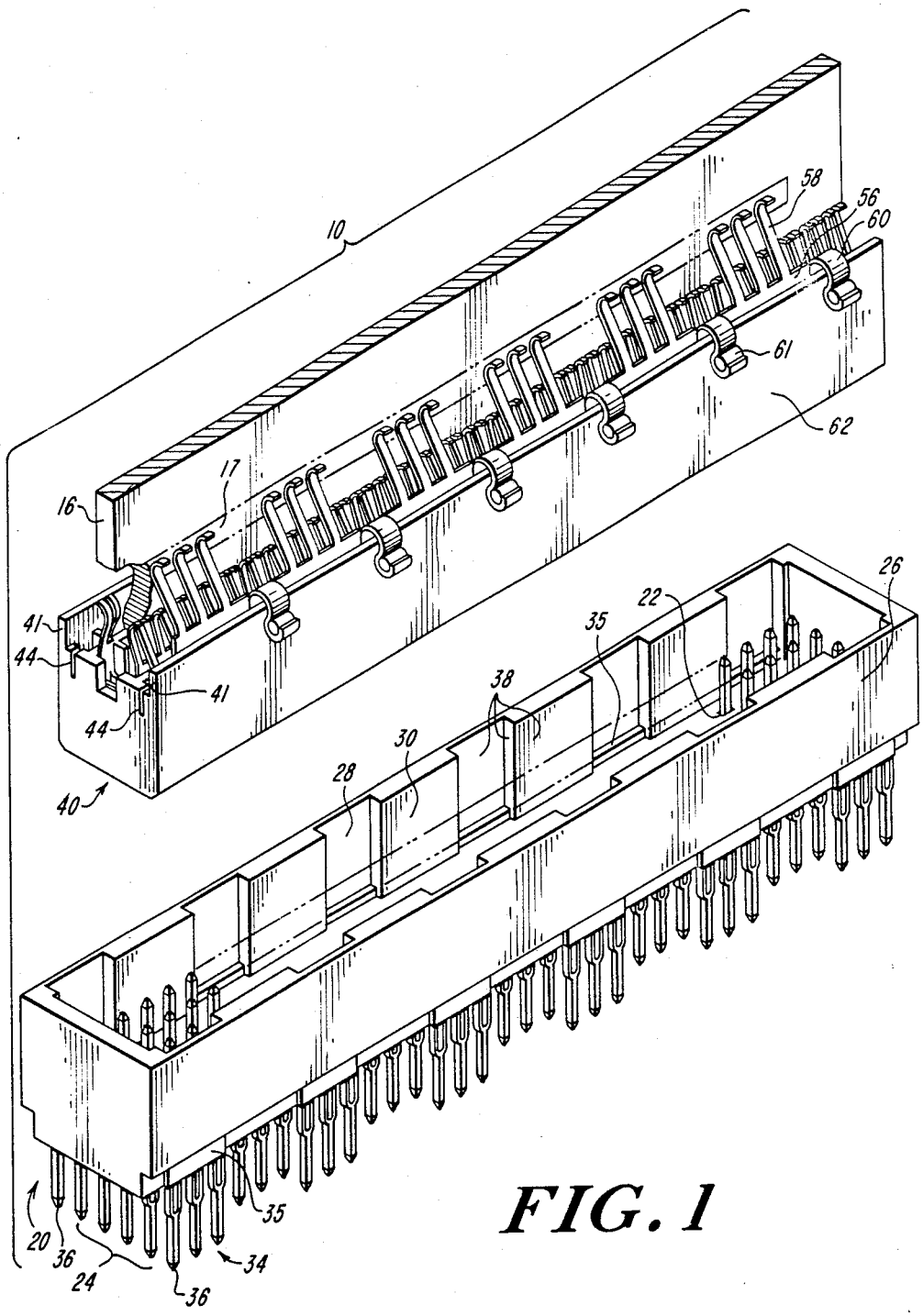
FIG. 1 is an exploded perspective view of a multi-row box connector according to the present invention.
Figure 2:
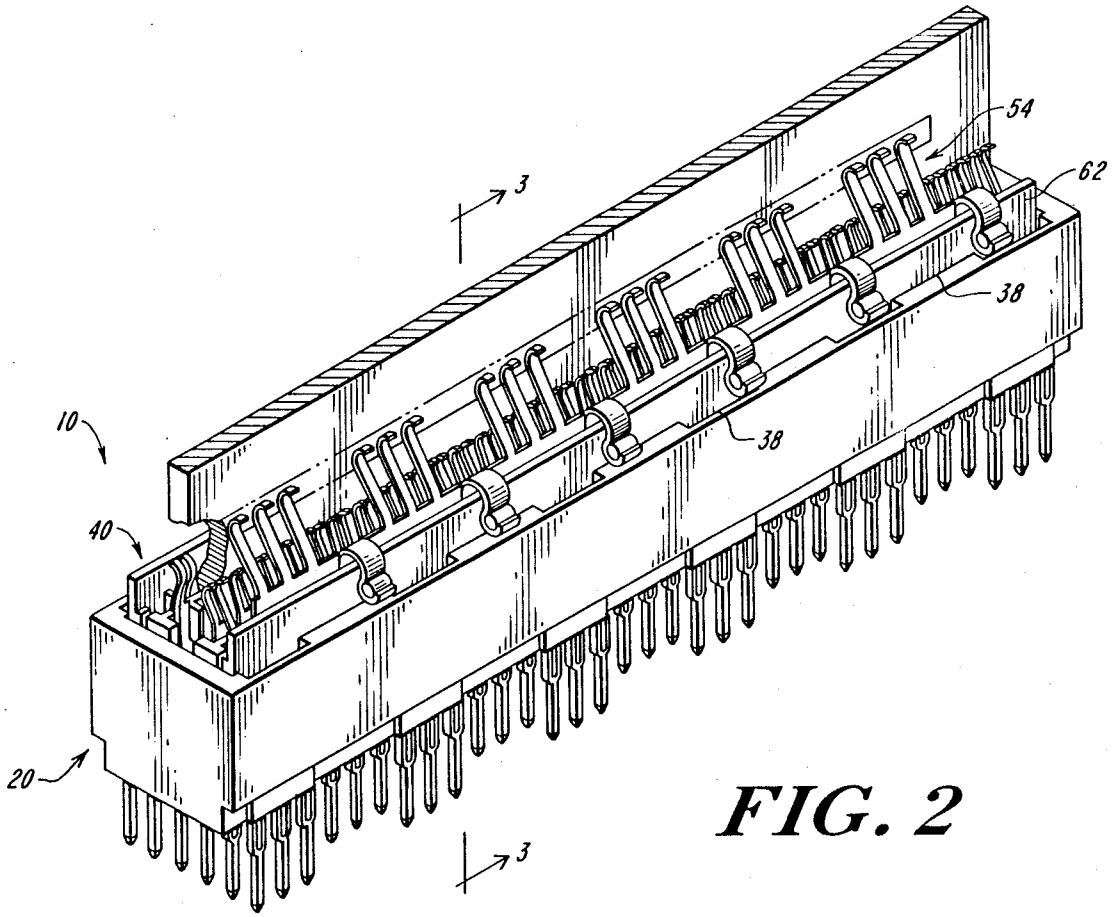
FIG. 2 is a perspective view of the multi row box connector of FIG. 1.

Referring now to the drawings wherein like reference numerals designate corresponding or similar elements throughout the several views, FIG. 1 is an exploded perspective view of an exemplary embodiment of a multi-row box connector 10 according to the present invention which is configured for electrically interconnecting printed circuit boards. The connector 10 includes a first housing member 20 and a second housing member 40.

Figure 3:
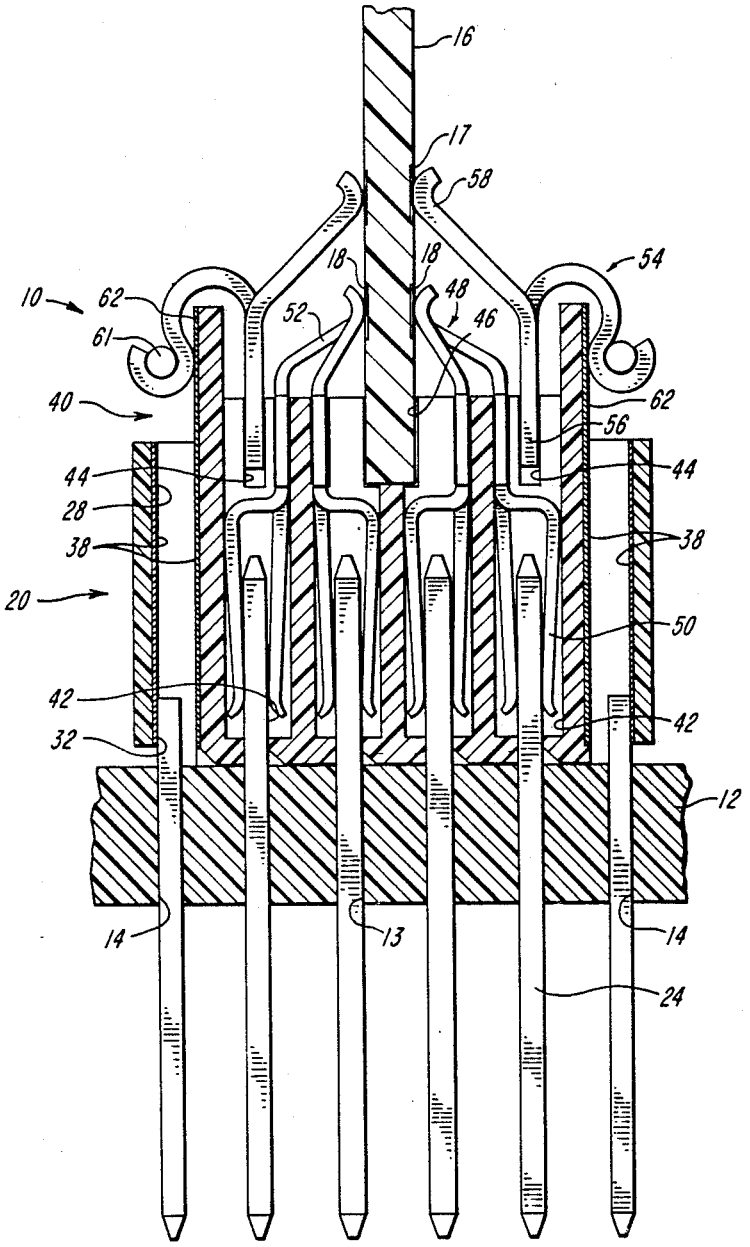
FIG. 3 is a cross-sectional view of the multi-row box connector of FIG. 2 taken along line 3—3 thereof.

The first housing member 20 is adapted to be mechanically and electrically engaged to a first printed circuit board 12 (see FIG. 3) as for example by press fitting. The first housing member 20 is formed from an insulative material such as plastic and has a plurality of signal pin apertures 22 formed therethrough. As exemplarily illustrated in FIGS. 1 and 3, the signal pin apertures 22 are arranged in four rows, each row containing a predetermined number of apertures 22 depending upon the application.

Figure 5A:
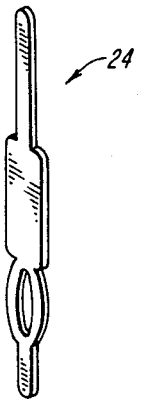
FIG. 5A is a perspective view of a signal pin for use in the multi-row box connector of FIGS. 1 and 2.

The signal pin apertures 22 are configured for press fit reception of a plurality of male signal pins 24 as exemplarily illustrated in FIG. 5A. The male signal pins 24 are configured for press fit reception into corresponding conductive receptacles 13 of the first circuit board 12.

Figure 5B:
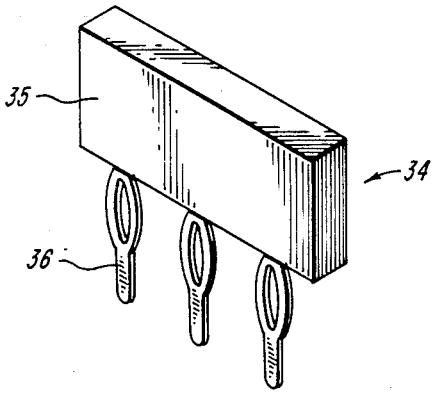
FIG. 5B is a perspective view of a ground pin module for use in the multi-row box connector of FIGS. 1 and 2.

The sidewalls 26 of the first housing member 20 are internally formed as alternating pluralities of channels 28 and lands 30. Mating apertures 32 are formed through the first housing member 20 coterminously with the channels 28. The mating apertures 32 are configured to receive ground pin modules 34 as exemplarily illustrated in FIG. 5B.

Each ground pin module 34 is integrally formed from a conductive material and includes a head 35 and a plurality of press fit posts 36 extending outwardly from the head 35. The head 35 is configured for mounting within the mating aperture 32. The press fit posts 36 are configured for press fit reception within corresponding ground receptacles 14 of the first circuit board 12.

The channels 28 and lands 30 of each sidewall 26 are coated with a conductive material such as copper. Coating may be accomplished by sputtering the conductive material onto the respective channels 28 and lands 30 of each sidewall 24. The conductively coated channels 28 and lands 30 in combination form a continuous bi-level ground plane 38 within the first housing member 20. With the ground pin modules 34 mounted within corresponding mating apertures 32, each head 35 mechanically and electrically engages the bi-level ground plane 38.

The second housing member 40 is adapted to mechanically and electrically engage a second printed circuit board 16 as discussed in further detail hereinbelow. The second printed circuit board 16 has grounding bars 17 formed on the opposed major surfaces thereof. The grounding bars 17 may have a continuous configuration or may be a plurality of discrete segments. Signal pads 18, electrically interconnected to the circuitry of the printed circuit board 17, are disposed on the opposed major surfaces thereof.

The second housing member 40 is formed from an insulative material and includes a plurality of signal contact receptacles 42 arranged in a predetermined number of rows, with a predetermined number of receptacles 42 per row, and a pair of opposed mating channels 44, 44. The second housing member 40 may also include a mating channel 46 configured to receive the edge of the second printed circuit board 16. The signal contact receptacles 42 are formed in the second housing member 40 in correspondence with the signal pin insertion apertures 22 of the first housing member 20.

The signal contact receptacles 42 are configured to receive a plurality of female signal contacts 48. As will be appreciated from an examination of FIG. 3, each female signal contact 48 includes resilient contact fingers 50 and a resilient extended segment 52. The resilient contact fingers 50 of each female signal contact 48 are configured to engage one end of a corresponding male signal pin 24. The resilient extended segment 48 of each female signal contact 48 is configured to engage a corresponding signal pad 18 of the second printed circuit board 16. The female signal contacts 48 may be soldered to corresponding signal pads 18.

Each mating channel 44 of the second housing member 40 is configured to receive a grounding bar 54. Each grounding bar 54 is integrally formed from a conductive material and includes an extended planar member 56, a plurality of resilient fingers 58 and a plurality of solder clips 60. The plurality of resilient fingers 58 are configured to engage the corresponding grounding bar 17 of the second printed circuit board 16. Each solder clip 60 includes a slug 61 of solder which is reflowed when the second printed circuit board 16 is engaged with the second housing member 40.

The sidewalls 41 of the second housing member 40 are externally coated with a conductive material such as copper. Coating may be accomplished by sputtering the conductive material onto the sidewalls 41. The conductively coated sidewalls form continuous ground planes 62. The solder clips 60 of the grounding bars 54 engage the corresponding ground planes 62 of the second housing member 40. The ground planes 62 are electrically interconnected to the corresponding grounding bars 17 of the second printed circuit board 16 via the grounding bars 54.

The first housing member 20 is disposed in combination with the first printed circuit board 12 as discussed hereinabove. The grounding planes 38 are electrically interconnected to the ground receptacles 14 of the first printed circuit board 12 via the ground pin modules 34.

The second housing member 40 is mated in combination with the first housing member 20 by inserting the second housing member 40 into the first housing member 20. Upon initial insertion, the ground planes 62 of the second housing member 40 engages the ground planes 38 of the first housing member 20, thereby providing an early mate ground interconnection between the first and second printed circuit boards 12, 16. Final mating between the first and second housing members 20, 40 causes the female signal contacts 48 to engage corresponding male signal pins 24, thereby providing electrical signal interconnection between the first and second printed circuit boards 12, 16.

In addition to providing early ground mating, the ground planes 38, 62 also provide EMF shielding for and minimize cross talk between the signal conducting elements of the first and second housing members 20, 40. The ground planes 38, 62 also provide controlled impedance, inductance and capacitance for the multi-row box connector 10. The ground planes 38, 62, in combination with the ground pin modules 34 and the grounding bars 54, enhance the signal pin availability of the multi-row box connector 10.

Figure 4:
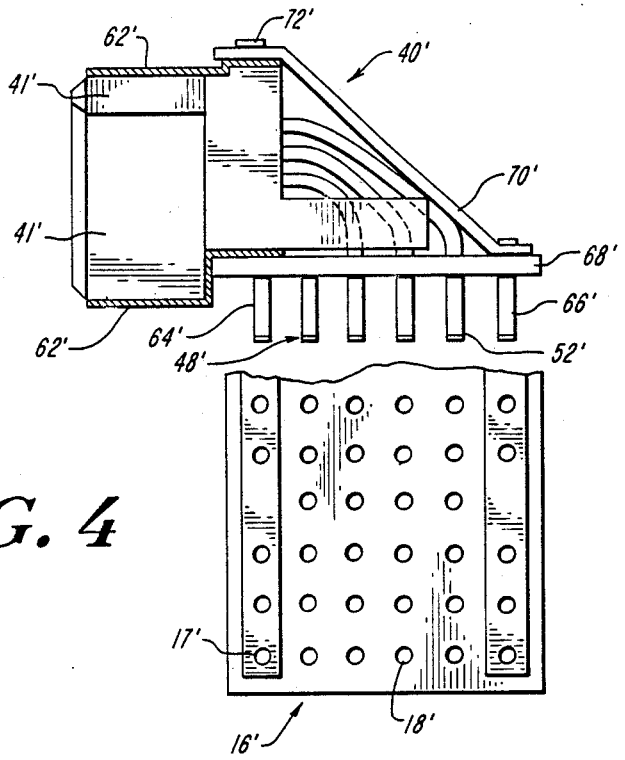
FIG. 4 is a plan view of another embodiment of a multi-row box connector according to the present invention.

Another embodiment of a multi-row box connector 10' according to the present invention is illustrated in FIG. 4. The first housing member 20' includes the elements and is configured as described hereinabove. The second housing member 40', as shown in FIG. 4, is configured to mechanically and electrically engage a second printed circuit board 16' having conductive ground and signal receptacles 17', 18', respectively, by press fitting.

The female signal contacts 48' of this embodiment include a post segment 52' configured for press fit reception into corresponding signal receptacles 18'. In lieu of the grounding bar, the second housing member 40' includes a plurality of headless pins 64' and a plurality of headed pins 66' mounted in a plate member 68' of insulative material. The second housing member 40' further includes a conductive ground plane member 70. secured thereto by means of a heat stake 72'.

The sidewalls 41' of the second housing member 40' are externally coated with a conductive material such as copper. Coating may be accomplished by sputtering the conductive material onto the sidewalls 41' as shown. The conductively coated sidewalls form continuous ground planes 62'. The plurality of headless pins 64' are electrically interfaced with one continuous ground plane 62' and the plurality of headed pins 66' are electrically interfaced with the other continuous ground plane 62' via the conductive ground plane member 70 .

A variety of modifications and variations of the present invention are possible in light of the above teachings. It is therefore to be understood that within the scope of the appended claims, the present invention may be practiced otherwise than as specifically described hereinabove.

What is claimed is:

1. A multi-row box connector for electrically interconnecting a first printed circuit board to a second printed circuit board, comprising:

first housing member means including a plurality of male signal pins arranged in a predetermined number of rows for surface mounting with the first printed circuit board, said plurality of male signal pins mechanically and electrically engaging corresponding signal elements of the first printed circuit board;

ground plane means formed by depositing thin metallic conductive coatings onto internal sidewalls of said first housing member means for providing electrical ground interconnection with the first printed circuit board;

ground pin module means mated in combination with said first housing member means to mechanically and electrically engage said ground plane means of said first housing member means and corresponding ground elements of the first printed circuit board for providing electrical ground interconnection therebetween;

second housing member means including a plurality of female signal contacts arranged in said predetermined number of rows for mounting the second printed circuit board thereto, said plurality of female signal contacts mechanically and electrically engaging corresponding signal elements of the second printed circuit board;

ground plane means formed by depositing thin metallic conductive coatings onto external sidewalls of said second housing member means for providing electrical ground interconnection with the second printed circuit board; and ground bar means mated in combination with said second housing member means to mechanically and electrically engage said ground plane means of said second housing member means and corresponding ground elements of the second printed circuit board for providing electrical ground interconnection therebetween;

said first and second housing member means in combination forming said multi-row box connector; and wherein said ground plane means of said first housing member means mechanically and electrically engaging said ground plane means of said second housing member to provide early ground mate for said multi-row box connector.

2. The multi-row box connector of claim 1 wherein said ground plane means of said first housing member means is formed by sputtering a conductive metal onto said internal sidewalls of said first housing member means.

3. The multi-row box connector of claim 1 wherein said ground plane means of said second housing member means is formed by sputtering a conductive metal onto said external sidewalls of said second housing member means.

4. The multi-row box connector of claim 1 wherein said first housing member means includes opposed sidewalls, each sidewall having a plurality of channels and lands alternately formed therein and wherein said plurality of channels and lands have said thin metallic coatings deposited thereon to form in combination said ground plane means of said first housing member means.

5. The multi-row box connector of claim 4 wherein said first housing member means includes a plurality of mating apertures formed coterminously with said plurality of channels and wherein said ground pin module means are disposed in combination with said first housing member means in said plurality of mating apertures to mechanically and electrically engage said ground plane means thereof.

6. The multi-row box connector of claim 5 wherein said ground pin module means comprises a plurality of ground pin modules, each ground pin module including a head configured for insertion in one of said plurality of mating apertures to mechanically and electrically engage said ground plane means of said first housing member means and a plurality of posts configured to mechanically and electrically engage corresponding ground elements of the first printed circuit board.

7. The multi-row box connector of claim 1 wherein said second housing member means includes spaced apart mating channels for mating said ground bar means in combination with said second housing member means.

8. The multi-row box connector of claim 7 wherein said ground bar means includes a first and second grounding bar, each said first and second grounding bar including an extended planar member configured for mating in said spaced apart mating channels, a plurality of resilient fingers for mechanically and electrically engaging corresponding ground elements of the second printed circuit board, and a plurality of solder clips to mechanically and electrically engage said ground plane means of said second housing member means.

9. The multi-row box connector of claim 1 wherein said second housing member means includes a mating channel for edge mounting of the second printed circuit board therewith.

* * * * *

UNITED STATES PATENT AND TRADEMARK OFFICE

CERTIFICATE OF CORRECTION

PATENT NO. : 4,932,888

DATED : June 12, 1990

INVENTOR(S) : Ronald E. Senor

It is certified that error appears in the above-identified patent and that said Letters Patent is hereby corrected as shown below:

In Column 2, line 5, "multi row" should read --multi-row--.

In Column 4, line 34, "70." should read --70'.--.

In Column 4, line 46, "70." should read --70'.--.

Signed and Sealed this

Sixth Day of October, 1992

*Attest:*

*Attesting Officer*

DOUGLAS B. COMER

*Acting Commissioner of Patents and Trademarks*